US010621853B2

(12) United States Patent
Hirayama

(10) Patent No.: US 10,621,853 B2
(45) Date of Patent: Apr. 14, 2020

(54) ELECTRONIC APPARATUS AND METHOD

(71) Applicant: KABUSHIKI KAISHA TOSHIBA, Minato-ku, Tokyo (JP)

(72) Inventor: Noriyuki Hirayama, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 268 days.

(21) Appl. No.: 15/256,169

(22) Filed: Sep. 2, 2016

(65) Prior Publication Data

US 2017/0213443 A1 Jul. 27, 2017

(30) Foreign Application Priority Data

Jan. 25, 2016 (JP) ..... 2016-011355

(51) Int. Cl.
*G08B 21/24* (2006.01)
*G08B 25/10* (2006.01)

(52) U.S. Cl.
CPC ..... *G08B 21/24* (2013.01); *G08B 25/10* (2013.01)

(58) Field of Classification Search
None
See application file for complete search history.

(56) References Cited

U.S. PATENT DOCUMENTS

2010/0266125 A1 10/2010 Tanaka et al.
2014/0092146 A1 4/2014 Hitaka
2015/0356862 A1* 12/2015 Daoura ..... G08B 25/10 340/686.6

FOREIGN PATENT DOCUMENTS

JP 2002297888 A 10/2002
JP 2003-177980 A 6/2003
JP 2009-74930 A 4/2009
JP 2011-15452 A 1/2011
JP 2014-72783 A 4/2014
JP 2015-222880 A 12/2015
WO 2009/041033 A1 4/2009

OTHER PUBLICATIONS

"Kaden (Home Appliances) Concierge for REGZA Tablet", Mar. 2014, 2 pages, https://www.toshiba.co.jp/regza/tablet/benefit/1403kadenconcierge/index_j.htm.

* cited by examiner

*Primary Examiner* — Curtis A Kuntz
*Assistant Examiner* — Shawna M Kingston
(74) *Attorney, Agent, or Firm* — Rutan & Tucker, LLP

(57) ABSTRACT

According to one embodiment, an electronic apparatus includes a memory, a receiver and a hardware processor. The memory stores first information associated with a first electronic apparatus and second information associated with a second electronic apparatus. The receiver receives a first beacon from the first electronic apparatus and receives a second beacon from the second electronic apparatus. The hardware processor outputs a first message related with a status or a function of the first electronic apparatus by using the first information after a reception of the first beacon and outputs a second message related with a status or a function of the second electronic apparatus by using the second information after a reception of the second beacon.

8 Claims, 10 Drawing Sheets

| | Appliance name | Time | Content |
|---|---|---|---|
| 1 | Washing machine | 2015/10/08 09:10 | URL |
| 2 | Air-conditioner | 2015/10/08 11:30 | URL |
| 3 | Refrigerator | 2015/10/08 14:00 | Hello. I recommend you to cook a tomato dish today. |
| 4 | Microwave oven | 2015/10/08 19:10 | You haven't taken out warmed sake. |
| 5 | Robot cleaner | 2015/10/09 10:00 | Cleaning will start soon. Tidy up the room. |
| | ... | ... | ... |

FIG. 6

ELECTRONIC APPARATUS AND METHOD

CROSS-REFERENCE TO RELATED APPLICATIONS

This application is based upon and claims the benefit of priority from Japanese Patent Application No. 2016-011355, filed Jan. 25, 2016, the entire contents of which are incorporated herein by reference.

FIELD

Embodiments described herein relate generally to an electronic apparatus having a communication function and a method applied to the electronic apparatus.

BACKGROUND

In recent years, household electrical appliances (home appliances), which include a communication device and have a function for notifying a user of a message based on the state of the respective appliances, have been developed. For example, washing machines include a sensor and a communication device. The sensor detects an abnormal state such as clogging of the drain or unbalanced laundry or the state of completion of washing. The communication device transmits notification data based on the detection result of the sensor to a portable terminal of the user. These home appliances are also called smart home appliances.

Portable terminals include a smartphone, a tablet computer (tablet) and a mobile phone. When a portable terminal has received notification data, the portable terminal notifies the user that data has been received by means of sound, light or vibration. When the user has recognized the notification of data reception, and has performed an operation, the user can confirm a message corresponding to notification data by character display or sound output. As a result, the user can take a suitable action based on the message. For example, when the message alerts the user that an abnormal state has occurred, the user can check the washing machine and take measures to eliminate the abnormal state. When the message notifies the user that washing has been completed, the user can take out the laundry immediately. This configuration prevents the laundry from remaining in the machine for a long time and getting wrinkled.

When a home appliance generates notification data for presenting a message to the user, the notification data is transmitted from the home appliance to a portable terminal of the user regardless of the state of the user. In this way, the message is presented to the user. When the user is not present near the home appliance which is the sender of the notification data, or when the user is tied up with something else, the user cannot take a suitable action immediately. Moreover, when the user keeps the receipt of the notification data or the message in mind, and intends to deal with the issue later, the user may forget to do it.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIG. 6 shows an example of notification data stored in a notification database.

FIG. 93 is a flowchart showing an example of the procedure of a cooperation process executed by a home appliance which communicates with the electronic apparatus of the second embodiment.

DETAILED DESCRIPTION

Various embodiments will be described hereinafter with reference to the accompanying drawings.

In general, according to one embodiment, an electronic apparatus includes a memory, a receiver and a hardware processor. The memory is configured to store first information associated with a first electronic apparatus and second information associated with a second electronic apparatus. The receiver is configured to receive a first beacon signal from the first electronic apparatus and receive a second beacon signal from the second electronic apparatus. The hardware processor is configured to output a first message related with a status or a function of the first electronic apparatus by using the first information after a reception of the first beacon signal. The hardware processor is further configured to output a second message related with a status or a function of the second electronic apparatus by using the second information after a reception of the second beacon signal.

A first embodiment will be described hereinafter with reference to the accompanying drawings.

Figure 1:
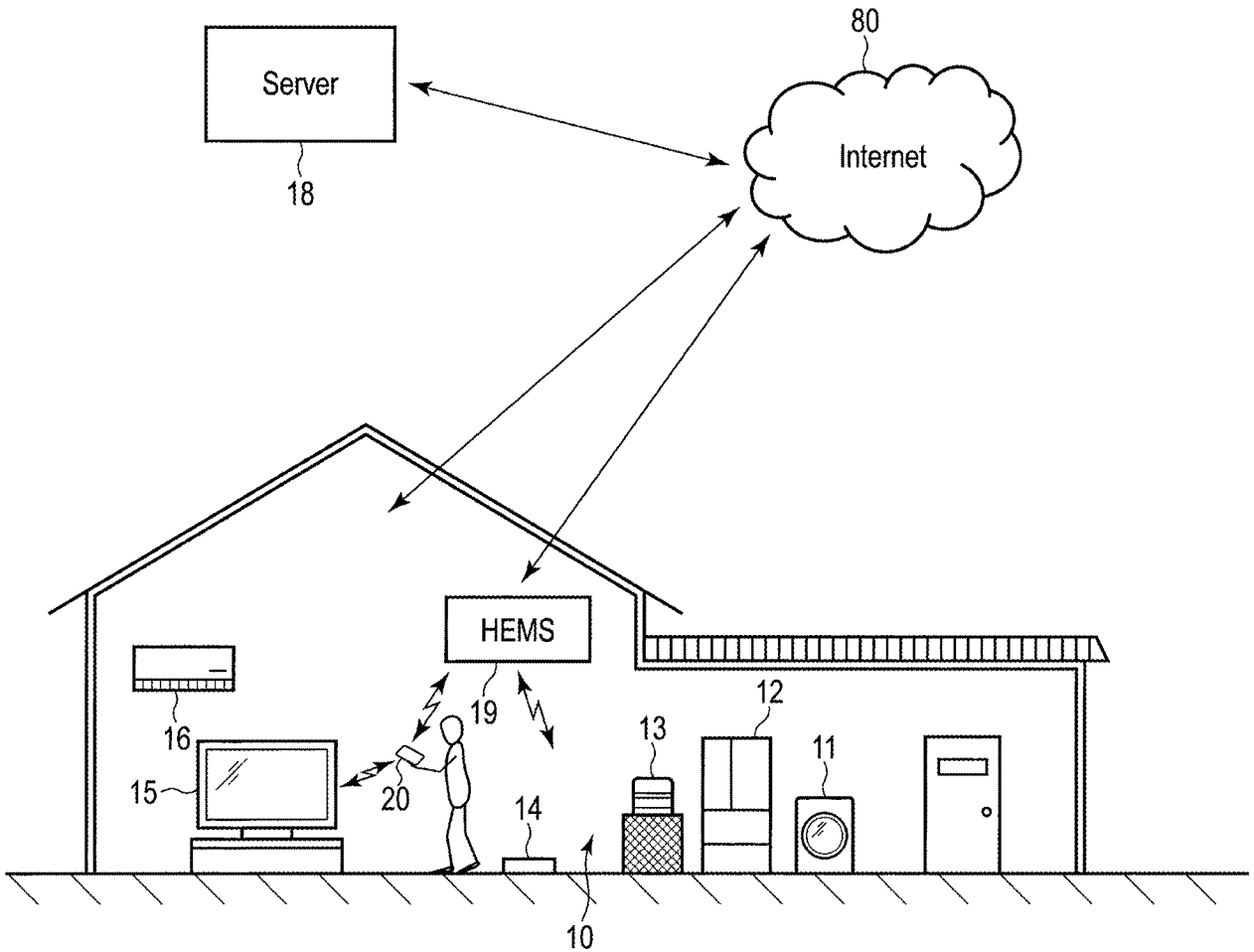
FIG. 1 shows a configuration example of a cooperation system including home appliances and an electronic apparatus according to a first embodiment.

FIG. 1 shows a configuration example of the cooperation system including smart home appliances and an electronic apparatus according to the first embodiment.

This system includes an electronic apparatus 20 having a communication function, and home appliances (referred to as smart home appliances) 10 having a communication function. The electronic apparatus 20 is a portable terminal which is owned by the user. The electronic apparatus 20 is, for example, a tablet, a smartphone or a mobile phone. Here, it is assumed that the electronic apparatus 20 is a smartphone.

The home appliances 10 include, for example, a washing machine 11, a refrigerator 12, a microwave oven 13, a robot cleaner 14, a television 15, and an air-conditioner 16. Each home appliance 10 includes, for example, a sensor for detecting the state of the appliance. If the sensor has detected that the home appliance 10 has transitioned to a predetermined state, the home appliance 10 transmits notification data (message data) to the smartphone 20. The notification data includes, for example, text as an instruction or an alarm for the user based on the detected state. The message to be presented to the user is generated based on the text. Alternatively, regardless of the detection result of the sensor, the home appliance 10 may transmit notification data, which includes an instruction for the smartphone 20 or the user having the smartphone 20, to the smartphone 20 at a predetermined time. An example of the instruction is as follows: "receive web data from a predetermined web site by connecting to the Internet." In this case, the message to be presented to the user is changed based on the received web data. Further, the home appliance 10 may be controlled remotely based on a control signal from the smartphone 20. Thus, the smartphone 20 may operate as a remote control of the home appliance 10.

If the smartphone 20 has received notification data from one of the home appliances 10, the smartphone 20 produces notification sound or voice, lights or blinks a lamp (light emitting module such as an LED), or activates a vibrator. In this manner, the smartphone 20 notifies the user of the receipt of notification data. If the user has recognized the notification of data reception, and has performed an operation, a message corresponding to the notification data may be displayed as characters on a screen of a display or may be output as a voice message from a speaker.

For the communication of notification data and control signals between the home appliances 10 and the smartphone 20, a function of mobile phone communication based on 3G/LTE may be used. Alternatively, a function of near-field communication based on Wi-Fi (registered trademark) or Bluetooth (registered trademark) may be used for the communication between the home appliances 10 and the smartphone 20. For Bluetooth communication, Bluetooth Basic Rate/Enhanced Data Rate (BR/EDR) communication, or Bluetooth Low Energy (BLE) communication that consumes less power may be used. The communication between the home appliances 10 and the smartphone 20 may be performed directly, or may be performed indirectly via a home gateway 19 of a Home Energy Management System (HEMS). The home appliances 10 and the smartphone 20 can communicate according to a communication protocol based on, for example, ECHONET Lite (registered trademark).

The home appliances 10 can access the Internet 80 via the smartphone 20 or the home gateway 19. Thus, the home appliances 10 can access a server 18 on the Internet 80.

Figure 2:
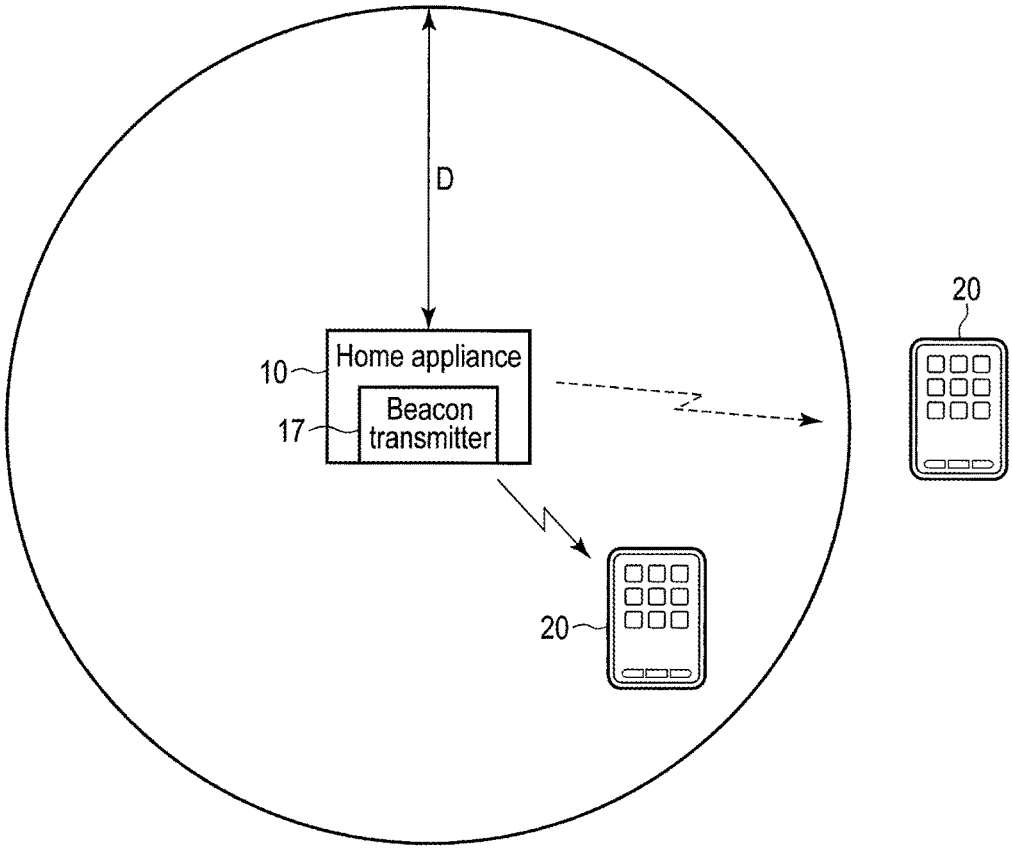
FIG. 2 is an exemplary schematic diagram showing the positional relationship between one of the home appliances transmitting a beacon signal and the electronic apparatus receiving a beacon signal in FIG. 1.

As shown in FIG. 2, a beacon transmitter 17 is provided in the home appliance 10. The beacon transmitter 17 need not be incorporated into the home appliance 10, and may be provided at least near the home appliance 10. Further, a beacon receiver (not shown in FIG. 2) is provided in the smartphone 20. The beacon transmitter 17 transmits a beacon (beacon signal) regularly, using BLE communication. For example, a beacon is transmitted once every several hundred milliseconds. The maximum range of beacon D is several ten centimeters to several ten meters, and is set arbitrarily by the user. Here, the maximum range of beacon D is set to one meter.

If the user having the smartphone 20 has entered the circular area within a radius of one meter of the home appliance 10 (beacon transmitter 17), the smartphone 20 can receive a beacon transmitted from the beacon transmitter 17. If the user has gone out of this circular area, the smartphone 20 cannot receive a beacon transmitted from the beacon transmitter 17. For example, a beacon receiver in the smartphone 20 is capable of receiving a beacon if a distance between the smartphone 20 and the home appliance 10 is less than one meter (first value). Furthermore, the beacon receiver is not capable of receiving a beacon if the distance between the smartphone 20 and the home appliance 10 is equal to or more than one meter (first value). Thus, if the smartphone 20 receives a beacon, it is presumed that the user is present near the home appliance 10 to the extent that the user can operate the home appliance 10 immediately. Conversely, if the smartphone 20 does not receive a beacon, it is presumed that the user is present at a position where the home appliance 10 cannot be operated immediately, such as outside the building or in a room different from the installation room of the home appliance 10. A beacon includes the identification data of the home appliance 10 which is the sender. With this configuration, if the smartphone 20 has received a beacon, the smartphone 20 can recognize near which home appliance 10 the smartphone 20 is present.

Figure 3:
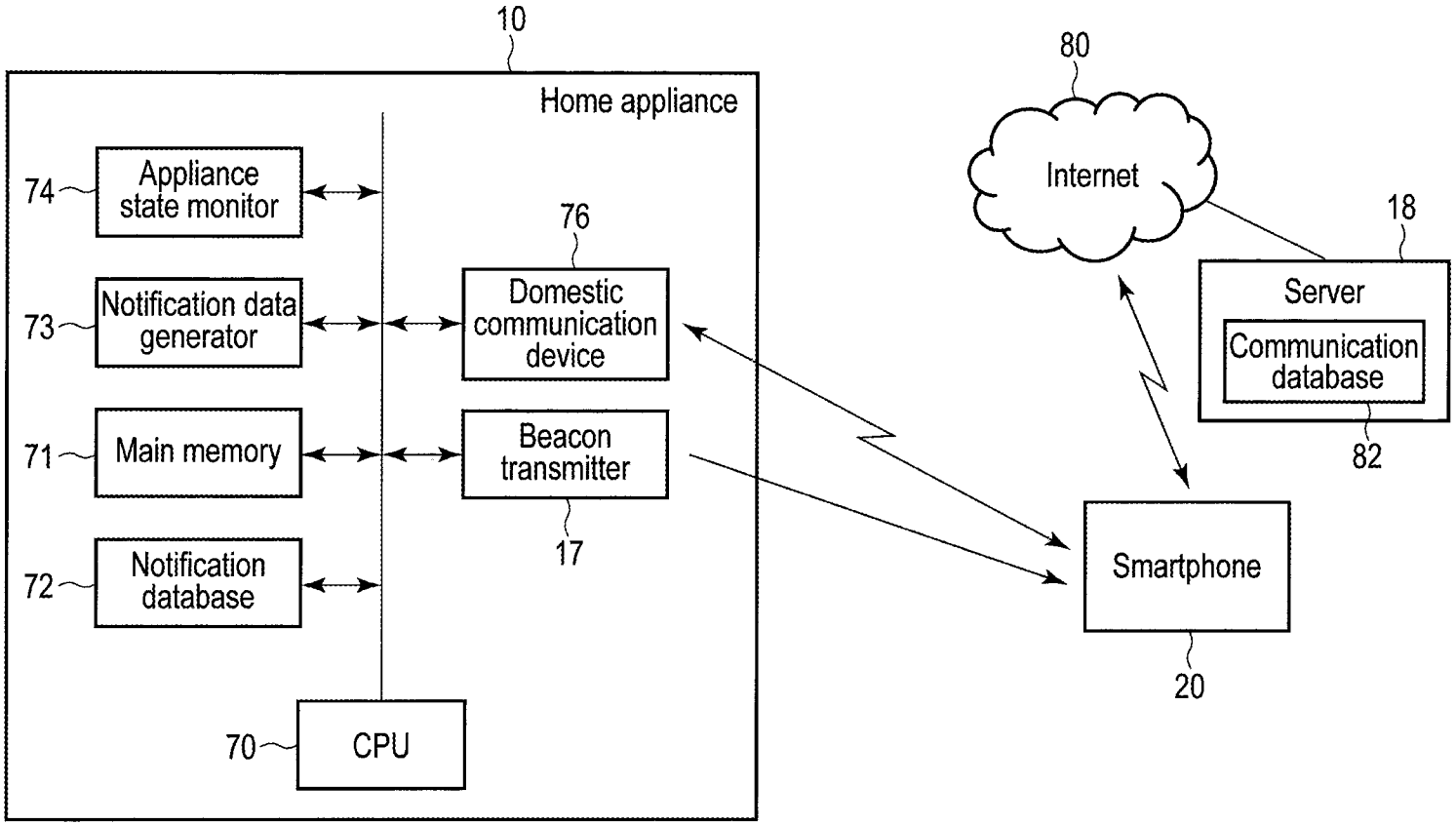
FIG. 3 is a block diagram showing an example of a system configuration of a part related to the cooperation with the electronic apparatus in one of the home appliances in FIG. 1.

FIG. 3 is a block diagram showing an example of the system configuration of a part related to the cooperation with the smartphone in the home appliance 10. The home appliance 10 includes a CPU 70, a main memory 71, a notification database 72, a notification data generator 73, an appliance state monitor 74, a domestic communication device 76, the beacon transmitter 17, etc. For example, the CPU 70 performs a processing for the operation sequence related to the cooperation with the smartphone 20 in accordance with an application program. The main memory 71 stores various types of application programs executed by the CPU 70. In the present embodiment, the notification database 72 is provided in a storage device such as a flash memory. In the notification database 72, notification data generated by the notification data generator 73 is stored for transmitting the notification data later instead of transmitting the notification data at the time of generation. The details of this configuration are explained later. Notification data need not be stored in the home appliance 10, and may be stored in the notification database 72 of the server 18.

The appliance state monitor 74 includes a camera which is set near the home appliance 10 for capturing the external appearance, a camera which is incorporated into the home appliance 10 such as the refrigerator 12 for capturing the inside, a sensor which detects the start or completion of operation or abnormality of the home appliance 10, etc. The appliance state monitor 74 transmits the state of the appliance 10 or a change in the state to the notification data generator 73.

The notification data generator 73 generates notification data to be transmitted to the smartphone 20 based on the result of monitoring by the appliance state monitor 74. The notification data generator 73 may generate notification data in other ways. For example, the notification data generator 73 may generate notification data at the time of activation of the home appliance 10 or at a predetermined time. Alternatively, the notification data generator 73 may generate notification data if a request for transmitting notification data has been received from the smartphone 20.

The domestic communication device 76 has a function of near-field communication such as Wi-Fi or Bluetooth communication for transmitting/receiving a signal to/from the smartphone 20/home gateway 19 in accordance with ECHONET Lite. As explained above referring to FIG. 2, the beacon transmitter 17 transmits a beacon conforming to BLE. Therefore, if the domestic communication device 76 also communicates conforming to BLE, the beacon transmitter 17 and the domestic communication device 76 need not be provided separately, and may be provided as one component.

Figure 4:
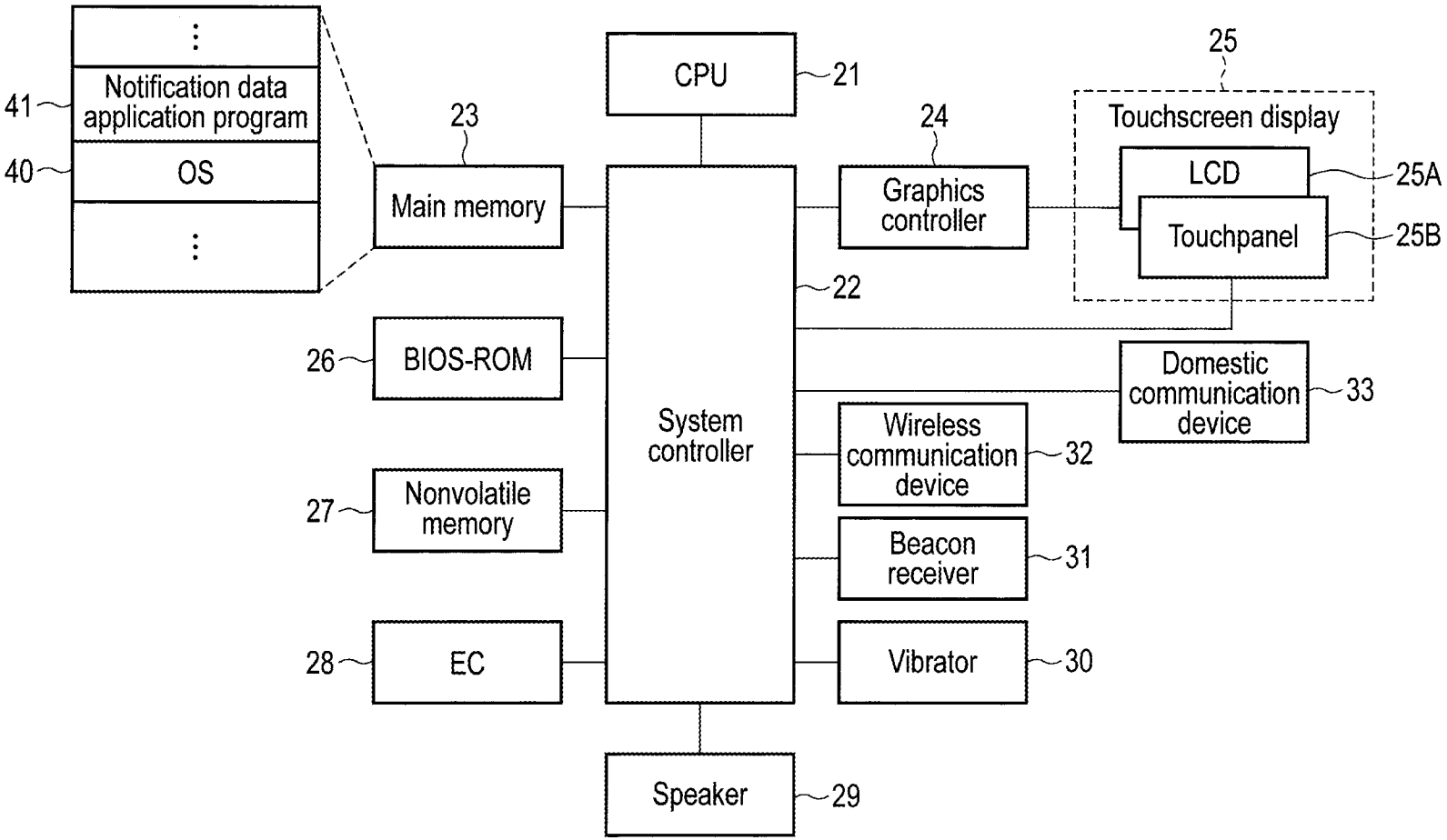
FIG. 4 is a block diagram showing an example of a system configuration of a part related to the cooperation with the home appliances in the electronic apparatus of the first embodiment.

FIG. 4 is a block diagram showing an example of the system configuration of a part related to the cooperation with the home appliances 10 in the smartphone 20.

The smartphone 20 includes a CPU 21, a system controller 22, a main memory 23, a graphics controller 24, a touchscreen display 25, a BIOS-ROM 26, a nonvolatile memory 27, an embedded controller (EC) 28, a speaker 29, a vibrator 30, a beacon receiver 31, a wireless communication device 32, a domestic communication device 33, etc.

The CPU 21 is a processor for controlling the operations of various components of the smartphone 20. The CPU 21 executes various types of computer programs loaded from the nonvolatile memory 27 which is a storage device into the main memory 23. The programs include an operating system (OS) 40 and various types of application programs. The application programs include a notification application program 41. The notification application program 41 has a function for obtaining/receiving notification data from the home appliance 10, a function for presenting a message based on the notification data, a function for, in some cases, receiving web data based on the notification data and presenting a message using the received web data, etc.

The CPU 21 also executes a basic input/output system (BIOS) stored in the BIOS-ROM 26. The BIOS is a program for hardware control.

The system controller 22 is a device for connecting a local bus of the CPU 21 and various components. A memory controller for controlling the access to the main memory 23 is incorporated into the system controller 22. The system controller 22 has a function for communicating with the graphics controller 24 via a serial bus conforming to the PCI EXPRESS standard, etc.

The graphics controller 24 is a display controller for controlling an LCD 25A used as a display monitor of the smartphone 20. A display signal generated by the graphics controller 24 is transferred to the LCD 25A. The LCD 25A displays a screen image based on the display signal. The LCD 25A displays a message generated by the notification application program 41. A touchpanel 25B is provided on the LCD 25A. The touchpanel 25B is, for example, a capacitive pointing device for inputting data on the screen of the LCD 25A. The touchpanel 25B detects, for example, the contact position of a finger on the screen and the movement of the contact position. The smartphone 20 may include a light-emitting module (lamp) such as an LED (not shown). The smartphone 20 can notify the user of the receipt of notification data by means of, for example, lighting or blinking of the light-emitting module under control of the notification application program 41.

The EC 28 is a single-chip microcomputer including an embedded controller for power management. The EC 28 has a function for turning the smartphone 20 on or off in accordance with the operation of the power button by the user.

The speaker 29 outputs voice at the end of the line or sound instructed by various types of application programs executed on the smartphone 20. The speaker 29 can output sound (voice) corresponding to a message generated by the notification application program 41. The speaker 29 is also allowed to notify the user of the receipt of notification data by outputting notification sound under control of the notification application program 41.

The vibrator 30 presents vibration to the user instructed by various types of application programs executed on the smartphone 20. The vibrator 30 can notify the user of the receipt of notification data by means of vibration under control of the notification application program 41.

The beacon receiver 31 receives a beacon which is transmitted from the beacon transmitter 17 of the home appliance 10 using BLE communication. For example, the beacon receiver 31 receives a first beacon signal from a first home appliance 10 (first electronic apparatus) and receives a second beacon signal from a second home appliance 10 (second electronic apparatus). If the smartphone 20 has received a beacon via the beacon receiver 31, the smartphone 20 activates the notification application program 41. The notification application program 41 performs predetermined processing, receives notification data from the home appliance 10, creates a message, and provides the user with the message. The notification application program 41 can receive a beacon and a notice packet (described later) transmitted from the home appliance 10 even before the notification application program 41 is activated. Thus, in a manner similar to that of common e-mail applications, the notification application program 41 can receive a beacon and a notice packet transmitted from the home appliance 10 even if the notification application program 41 is not operated constantly.

The wireless communication device 32 is configured to perform wireless communication conforming to a mobile communication standard of 3G/LTE etc. For example, the smartphone 20 is connected to the server 18 on the Internet 80 by using the wireless communication device 32.

The domestic communication device 33 has a function of near-field communication based on Wi-Fi, Bluetooth etc. for transmitting/receiving a signal (data signal) to/from the home appliance 10 or home gateway 19 in accordance with ECHONET Lite. In a manner similar to that of the home appliance 10, if the domestic communication device 33 communicates conforming to BLE, the beacon receiver 31 and the domestic communication device 33 need not be provided separately, and may be provided as one component. The domestic communication device 33 may be configured to connect to the server 18 on the Internet 80 using a Wi-Fi communication function.

Figure 5:
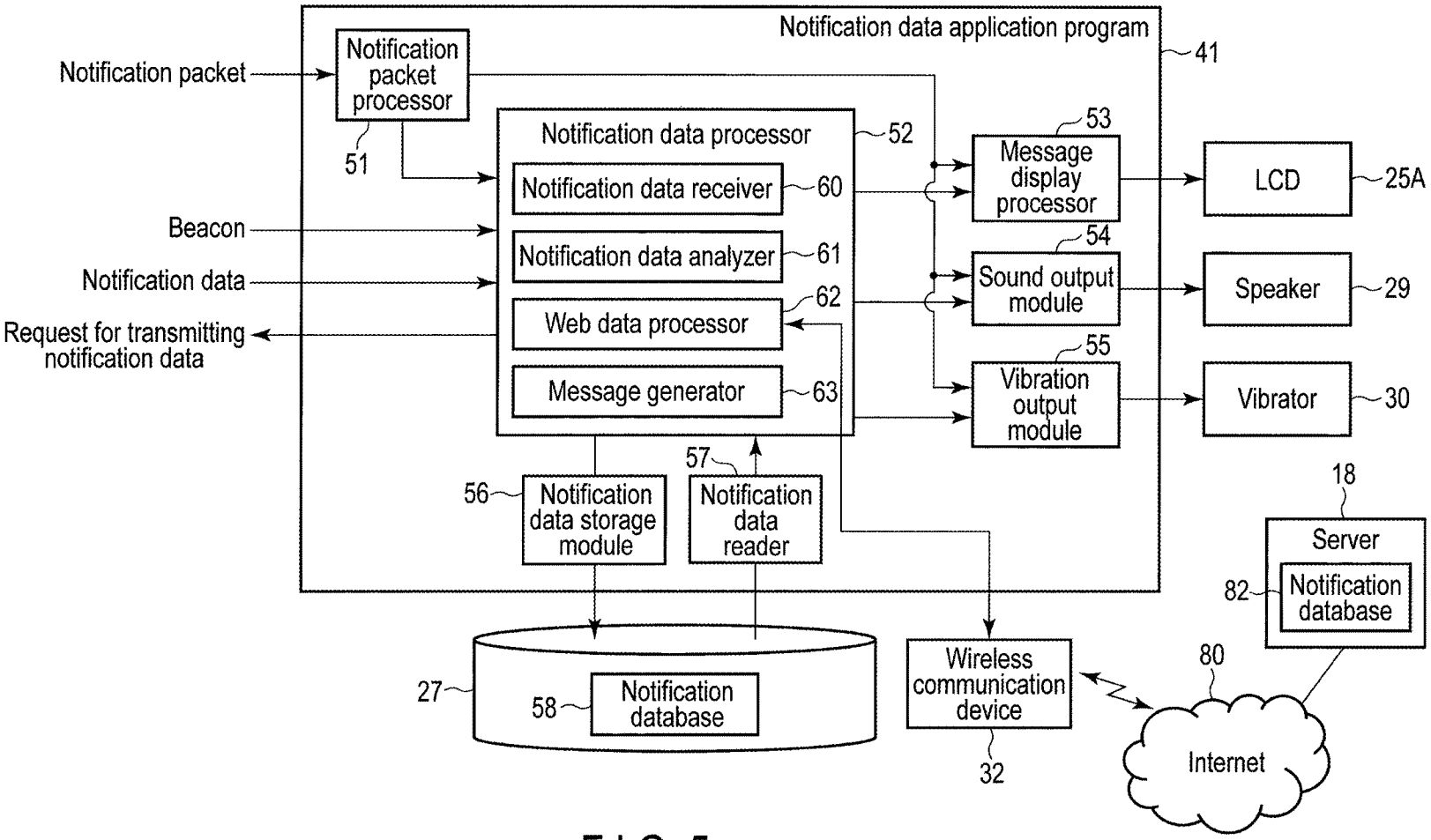
FIG. 5 is a block diagram showing an example of a functional configuration of a notification application program executed by the electronic apparatus of the first embodiment.

Now, this specification explains an example of the functional configuration of the notification application program 41 with reference to FIG. 5.

The notification application program 41 includes a notice packet processor 51, a notification data processor 52, a message display processor 53, a sound processor 54, a vibration processor 55, a notification data storage module 56, a notification data reader 57, a notification database 58, etc. The notification data processor 52 includes a notification data receiver 60, a notification data analyzer 61, a web data processor 62, a message generator 63, etc. The notification database 58 may store information associated with each home appliance 10. The notification database 58 may store, for example, first information associated with a first home appliance 10 (first electronic apparatus) and/or second information associated with a second home appliance 10 (second electronic apparatus).

If the notice packet processor 51 has received a notice packet transmitted from one of the home appliances 10, the notice packet processor 51 transfers the notice packet to the notification data processor 52 (the notification data receiver 60), the message display processor 53, the sound processor 54, and the vibration processor 55. The home appliance 10 transmits the notice packet by means of the domestic communication device 76 before transmitting notification data used to notify the user of a change in the state, etc. The notice packet includes the identification data of the home appliance 10 which is the sender in a manner similar to that of a beacon. In the case of the washing machine 11, the change in the state of the home appliance 10 is, for example, start or completion of washing, or occurrence of abnormality such as clogging of the drain. The message display processor 53, the sound processor 54 and the vibration processor 55 can notify the user of the receipt of the notice packet by means of character display, sound, vibration, etc.

If the notice packet transferred from the notice packet processor 51 has been received, the notification data receiver 60 transmits a request for transmitting notification data to the home appliance 10 which is the sender of the notice packet. In response to the request, the home appliance 10 transmits notification data to the smartphone 20 (the notification data receiver 60). The notification data receiver 60 receives the notification data transmitted from the home appliance 10 and transfers the received notification data to the notification data analyzer 61 or the notification data storage module 56.

If the notification data storage module 56 has received the notification data, the notification data storage module 56 writes the notification data to the notification database 58 in the nonvolatile memory 27. The notification data storage module 56 may write the notification data to the notification database 82 in the server 18 on the Internet 80 by using the wireless communication device 32.

At least one of the message display processor 53, the sound processor 54 and the vibration processor 55 outputs a first message related with a status or a function of the first home appliance 10 by using the first information after a reception of a first beacon signal from the first home appliance 10. At least one of the message display processor 53, the sound processor 54 and the vibration processor 55 also outputs a second message related with a status or a function of the second home appliance 10 by using the second information after a reception of a second beacon signal from the second home appliance.

More specifically, if the beacon receiver 31 has received a beacon from one of the home appliances 10, the notification data receiver 60 may transmit a request for transmitting notification data to the home appliance 10 which is the sender of the beacon and cause the home appliance 10 to transmit notification data to the smartphone 20. The notification data receiver 60 may receives notification data from the home appliance 10. At least one of the message display processor 53, the sound processor 54 and the vibration processor 55 may determine (output) a message by using not only information stored in the notification database 58 but also the received notification data.

If the beacon receiver 31 has received a beacon from one of the home appliances 10, the notification data reader 57 may read notification data from the notification database 58 or the notification database 82. The notification data reader 57 transmits the read notification data to the notification data analyzer 61.

The notification data analyzer 61 analyzes the content of the notification data received by the notification data receiver 60 or the content of the notification data read by the notification data reader 57. If the notification data includes text as a result of analysis, the notification data analyzer 61 transmits the text to the message generator 63. If the notification data includes a URL as a result of analysis, the notification data analyzer 61 transmits the URL to the web data processor 62.

If the web data processor 62 has received the URL from the notification data analyzer 61, the web data processor 62 receives web data corresponding to the URL from a web server on the Internet 80 by using the wireless communication device 32. The web data processor 62 transmits the received web data to the message generator 63.

If the message generator 63 has received the text from the notification data analyzer 61, the message generator 63 generates a message by using the received text. In this case, the message generator 63 may generate a message by using not only information stored in the notification database 58 but also the received text. If the message generator 63 has received the web data from the web data processor 62, the message generator 63 generates a message by using the received web data. In this case, the message generator 63 may generate a message by using not only information stored in the notification database 58 but also the received web data. The message generator 63 may generate a message by using both the text received from the notification data analyzer 61 and the web data received from the web data processor 62. The generated message is transmitted to at least one of the message display processor 53, the sound processor 54 and the vibration processor 55. The message display processor 53 displays the message as characters on the LCD 25A. The sound processor 54 generates voice data corresponding to the message by speech synthesis, and causes the speaker 29 to output voice based on the generated voice data. The vibration processor 55 causes the vibrator 30 to vibrate in accordance with the message.

FIG. 6 shows an example of notification data stored in the notification database 72 of the home appliance 10, the notification database 58 of the smartphone 20 and the notification database 82 of the server 18. The notification data includes records corresponding to items of information (notification) that are generated by the home appliances 11 to 16. Each record of the notification data indicates a status or a function of a home appliance 10. Each record of the notification data may include an appliance name field, a time field, and a content field. The appliance name field shows a name of a home appliance. In the appliance name field, for example, the name of one of the home appliances 11 to 16 is described. The time field shows the time (date and time) if each record was registered (generated) or the time if a home appliance generated an item of information. The time if a home appliance generated an item of information includes, for example, the time if the state of the appliance was changed, and the time if the appliance was activated or terminated by a timer. In the content field, for example, the text to be presented to the user or the URL for receiving web data is described. Each record may include an appliance ID field which shows identification imparted to the home appliance.

In addition to the examples shown in FIG. 6, information (text) may be presented to the user (that is, information may be provided from one of the home appliance to the smartphone 20) in the following cases.

In air-conditioners, for example, information is presented to: notify the user of the content of an error; allow the user to confirm the state of operation; or allow the user to confirm the consumed power.

In refrigerators, for example, information is presented to: notify the user that the cooling operation is bad; allow the user to confirm the consumed power; notify the user of the result of recognition of the inner image; allow the user to confirm the presence or absence of water for ice; allow the user to confirm the state of operation; or notify the user that the door is open for a long time.

In washing machines, for example, information is presented to: notify the user of clogging of the drain or unbalanced laundry; notify the user of completion of washing or drying; allow the user to confirm the state of operation; notify the user of the remaining time of washing or drying; allow the user to confirm the consumed power; or notify the user of clogging of lint trap.

Notification data transmitted by the home appliances 10 is not limited to notification data including the text to be presented to the user, and may be notification data including the instruction to be given to the smartphone 20. For example, in the case of washing machines and air-conditioners, the smartphone 20 may receive the web data of a weather forecast at a predetermined time in accordance with the instruction, and present a message corresponding to the forecast to the user. As shown in FIG. 6, the URL for accessing the web site of a weather forecast is described in the content field of each of record 1 for the washing machine 11 and record 2 for the air-conditioner 16. If the smartphone 20 has received this type of notification data, the smartphone 20 accesses the web site of the weather forecast and receives the web data of the weather forecast. The smartphone 20 creates a message in accordance with the web data of the weather forecast and presents the message to the user. If the web data shows that the weather forecast is good, for example, the smartphone may create messages "The chance of rain is very low today. Do the laundry!", and "It will be cold tomorrow morning. Set the timer of the heater."

Notification data including text corresponding to the state detected by the home appliance 10 includes the following examples. The refrigerator 12 has a function for capturing the inside with a camera, recognizing foodstuffs and suggesting a menu corresponding to the foodstuffs to the user. For example, if a tomato is inside the refrigerator 12, as shown in the content field in record 3 for the refrigerator 12, the following text is described: "Hello. I recommend you to cook a tomato dish today." The microwave oven 13 has a function for detecting the object forgotten in the oven. Record 4 for the microwave oven 13 shows an example of notification data generated if the sensor detects sake remaining for a predetermined time after it is heated. In the content field in record 4, the following text is described: "You haven't taken out warmed sake." The robot cleaner 14 has a function for automatically starting cleaning at a predetermined time in accordance with a timer. In the time field in record 5 for the robot cleaner 14, a time, which is a certain period earlier than the start time for cleaning, is described. In the content field in record 5, the following text is described: "Cleaning will start soon. Tidy up the room."

Figure 7A:
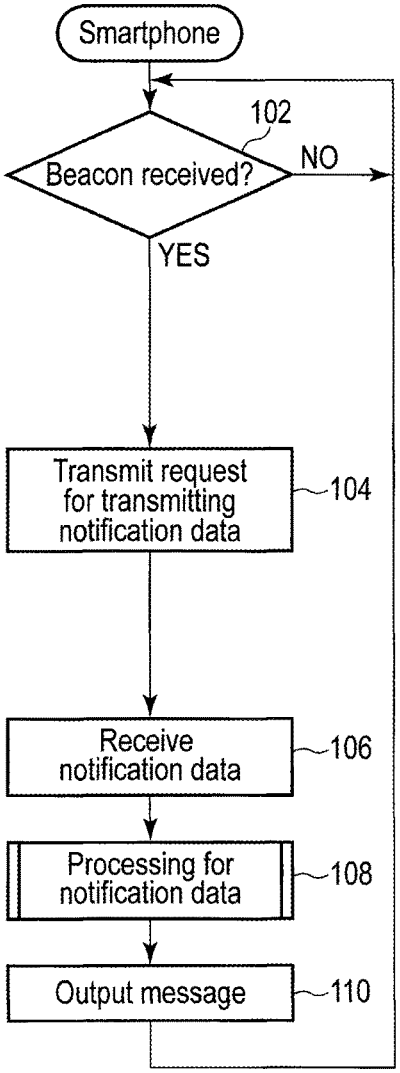
FIG. 7A is a flowchart showing an example of the procedure of a cooperation process executed by the electronic apparatus of the first embodiment.
Figure 7B:
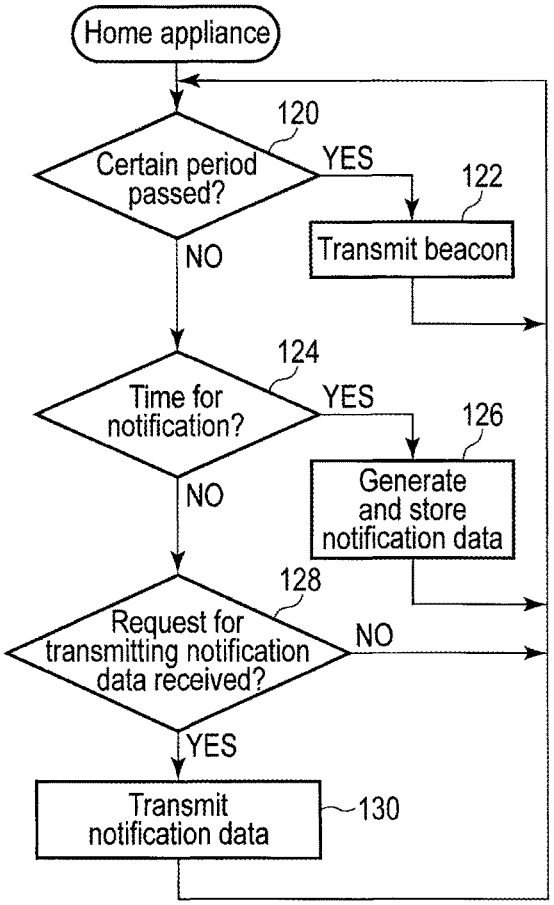
FIG. 7B is a flowchart showing an example of the procedure of a cooperation process executed by one of the home appliances which communicates with the electronic apparatus of the first embodiment.
Figure 8A:
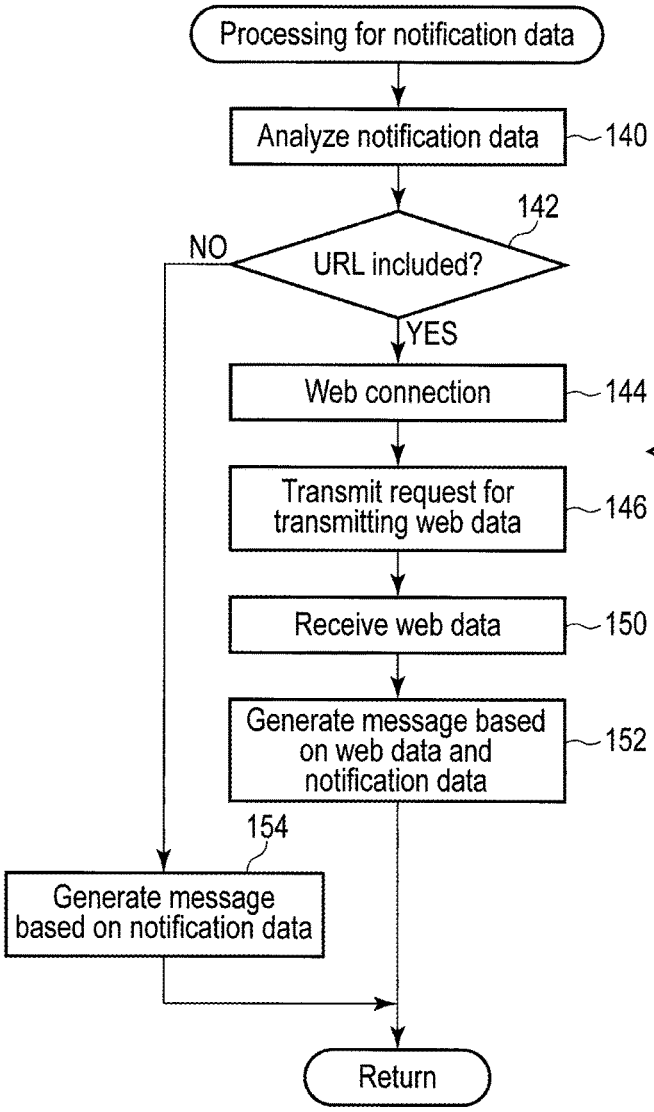
FIG. 8A is a flowchart showing an example of the procedure of a notification generation process in FIG. 7A executed by the electronic apparatus of the first embodiment.

The procedure of a cooperation process between each home appliance 10 and the smartphone 20 is explained with reference to the flowcharts of FIG. 7A, FIG. 7B, FIG. 8A, and FIG. 8B. FIG. 7A is a flowchart shown for explaining the operation of the smartphone 20. FIG. 7B is a flowchart shown for explaining the operation of the home appliance 10. FIG. 8A is a flowchart shown for explaining the operation of the smartphone 20 in relation to the processing for notification data in FIG. 7A. FIG. 7B is a flowchart shown for explaining the operation of a web server on the Internet 80.

As shown in FIG. 7B, the home appliance 10 determines whether a certain period has passed, for example, whether several hundred milliseconds have passed (block 120). If a certain period has passed (Yes in block 120), the home appliance 10 resets the timer and transmits a beacon (block 122). After transmitting the beacon, the processing returns to block 120. Thus, the home appliance 10 transmits a beacon at regular time intervals.

If the home appliance 10 determines that a certain period has not passed since the home appliance 10 transmitted the previous beacon (No in block 120), the home appliance 10 determines whether the current time is the time for notification (block 124). If the current time is the time for notification (Yes in block 124), for example, if a change in the state or abnormality of the appliance 10 has been detected, or if a predetermined time for notification has been reached, the home appliance 10 generates notification data as shown in FIG. 6 and stores the generated notification data in the notification database 72 of the appliance 10 or in the notification database 82 of the server 18 (block 126). After storing the notification data, the processing returns to block 120.

If the home appliance 10 determines that the current time is not the time for notification (No in block 124), the home appliance 10 determines whether a request for transmitting notification data has been received from the smartphone 20 (block 128). If a request for transmitting notification data has not been received (No in block 128), the processing returns to block 120. If a request for transmitting notification data has been received (Yes in block 128), the home appliance 10 reads notification data from the notification database 72 of the appliance 10 or the notification database 82 of the server 18, and then transmits the read notification data to the smartphone (block 130). After transmitting the notification data, the processing returns to block 120.

As described above, the home appliance 10 transmits a beacon at regular time intervals. At the time of occurrence of an event of which the home appliance 10 should notify the user, the home appliance 10 generates notification data but does not transmit the generated notification data to the smartphone 20 immediately. Instead, the home appliance 10 stores the notification data in the database 72 or 82 such that the data can be transmitted later. If a request for transmitting notification data has been transmitted from the smartphone 20, the home appliance 10 receives the request and then transmits the notification data stored in the database 72 or 82 to the smartphone 20. Thus, it is possible to adjust the time if notification data is received on the smartphone 20 by adjusting the time if the smartphone 20 transmits a request for transmitting notification data. If the smartphone 20 transmits a request for transmitting notification data to the home appliance 10 while the user is present near the home appliance 10, the smartphone 20 can receive notification data from the home appliance 10 at an appropriate time.

Then, the smartphone 20 can present a message to the user based on the received notification data.

As shown in FIG. 7A, the smartphone 20 (CPU 21) determines whether the smartphone 20 has received a beacon (block 102), in other words, whether the smartphone 20 has entered a circular area within a radius of one meter of the home appliance 10. The procedure of block 102 is executed (repeated) until a beacon is received.

If the smartphone 20 has received a beacon (Yes in block 102), the smartphone 20 transmits a request for transmitting notification data to the home appliance 10 which is the sender of the beacon (block 104). Specifically, if the smartphone 20 has received a beacon from the home appliance 10, the smartphone 20 activates the notification application program 41 and causes the notification data receiver 60 to transmit a request for transmitting notification data to the home appliance 10. As described above, if the home appliance 10 has received a request for transmitting notification data (Yes in block 128), the home appliance 10 transmits notification data to the smartphone 20 (block 130).

The smartphone 20 receives the notification data transmitted from the home appliance 10 (block 106) and then performs processing for notification data (block 108). In the processing for notification data, the message to be presented to the user is created. The details of the processing for notification data are explained later with reference to FIGS. 8A and 8B. The smartphone 20 presents the message created in the processing for notification data to the user (block 110). The message may be presented by: displaying the message as characters on the LCD 25, by using the message display processor 53; outputting a voice message corresponding to the message from the speaker 29, the voice message being generated by speech synthesis by the sound processor 54; or vibrating the vibrator 30 in accordance with the message by using the vibration processor 55. To output the message, only one form may be employed, or a plurality of forms may be combined.

The processing for notification data is explained with reference to FIGS. 8A and 8B. As shown in FIG. 8A, the smartphone 20 (CPU 21) analyzes the received notification data (block 140). Specifically, the notification data analyzer 61 of the notification application program 41 analyzes the content of notification data. In this analysis, the notification data analyzer 61 determines, for example, whether the content field of the notification data includes a URL.

The smartphone 20 determines whether the content field of the notification data includes a URL (block 142). If the content field does not include a URL (No in block 142), for example, if the content field includes text, the smartphone generates a message based on the notification data (text) (block 154). The smartphone 20 may generate a message by using information, which is associated with the home appliance 10 and is stored in the notification database 58, and the notification data. Specifically, the message generator 63 of the notification application program 41 generates the message to be presented to the user based on the content field of the notification data. For example, since the content field in the record 3 of the refrigerator 12 shown in FIG. 6 includes only text, the smartphone 20 determines that the content field does not include a URL, and then generates the message to be presented to the user based on the notification data (record 3). Similarly, in the cases of the microwave oven 13 in record 4 and the robot cleaner 14 in record 5 shown in FIG. 6, the content field of the notification data includes only text. Thus, the smartphone 20 generates the message to be presented to the user based on the notification data. Moreover, in the case of the washing machine 11, the following message may be created (not shown in FIG. 6): "Washing/drying was completed."

If the content field of the notification data includes a URL (Yes in block 142), the smartphone 20 performs the procedure of blocks 144 to 152. For example, since the content field in the record 1 of the washing machine 11 shown in FIG. 6 includes a URL, the procedure of blocks 144 to 152 is performed.

More specifically, the smartphone 20 establishes a connection to a web server based on the URL in the notification data (block 144). That is, the smartphone 20 is connected to the web server, which is specified in the URL, on the Internet 80 by using the wireless communication device 32. The smartphone 20 then transmits a request for transmitting web data to the web server, based on the URL (block 146).

Figure 8B:
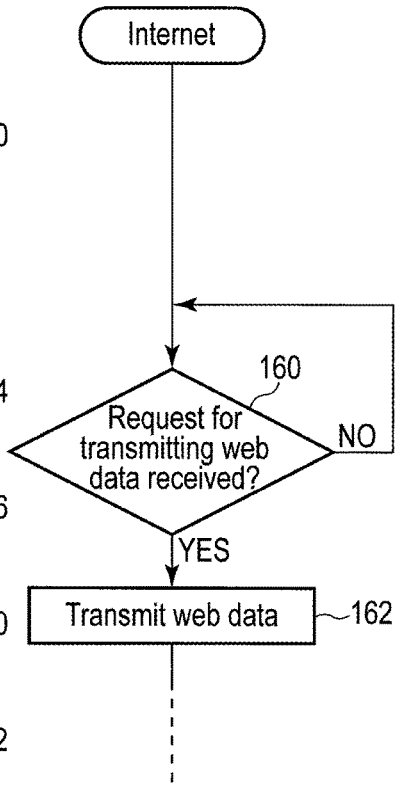
FIG. 8B is a flowchart showing an example of a web data transmission process executed by a web server which communicates with the electronic apparatus of the first embodiment.

As shown in FIG. 8B, the web server on the Internet 80 determines whether a request for transmitting web data has been received (block 160). If a request for transmitting web data has not been received (No in block 160), the procedure in block 160 is repeated until a request for transmitting web data is received. If a request for transmitting web data has been received (Yes in block 160), the web server transmits web data to the smartphone 20 (block 162). If the URL in the content field is the URL of a weather forecast website, the content of the weather forecast is transmitted to the smartphone 20 as web data.

As shown in FIG. 8A, the smartphone 20 receives the web data transmitted from the web server on the Internet 80 (block 150). The smartphone 20 generates the message to be presented to the user based on the web data, and if necessary, the notification data (block 152). The smartphone 20 may generate a message by using information, which is associated with the home appliance 10 and is stored in the notification database 58, the web data and the notification data. Specifically, the message generator 63 of the notification application program 41 generates the message to be presented to the user based on the web data received from the web server and notification data. For example, if the notification data received from the washing machine 11 includes the URL of a weather forecast web service, the smartphone 20 receives weather forecast data provided by the weather forecast web service based on the URL. If the weather forecast data indicates fine weather, the message generator 63 of the notification application program 41 generates the following message based on the notification data and the weather forecast data received from the web server on the Internet 80: "The weather is good today. Do the laundry!" In block 152, the message may be generated based on only the web data received from the web server on the Internet 80. That is, the notification data is used only for specifying a URL.

As explained above, in the present embodiment, if the user having the smartphone 20 is present near the home appliance 10, the smartphone 20 can receive a beacon from the home appliance 10. If the smartphone 20 has received a beacon, the smartphone 20 transmits a request for transmitting notification data to the home appliance 10. Thus, the smartphone 20 can receive notification data from the home appliance 10 at an appropriate time for the user instead of the desired time for notification on the home appliance 10, and can present the notification data (message) to the user. Since the user can take an action suitable for the notification data (message) immediately, the user can deal with the abnormality of the home appliance 10, etc., promptly. Thus, it is possible to realize a system of cooperation between home appliances and a smartphone in which the convenience has been improved.

In the first embodiment, a home appliance 10 transmits a beacon to the smartphone 20 in accordance with BLE, and the smartphone 20 receives the beacon. In this manner, the smartphone 20 detects the home appliance 10 which is in a close position. In a manner opposite to this configuration, the smartphone 20 may transmit a beacon to a home appliance 10, and the home appliance 10 may receive the beacon. In this way, the home appliance 10 may detect the smartphone 20 which is in a close position, and the home appliance 10 may transmit notification data to the smartphone 20 which is in a close position. If a home appliance 10 transmits a beacon, the beacon need not be transmitted in accordance with BLE, and other standards may be used for transmitting the beacon.

Now, other embodiments are explained. In the embodiments below, only the operation procedure is different. The configurations of the embodiments are identical to the configuration of the first embodiment explained above with reference to FIG. 1 to FIG. 6. Thus, the explanation of the configurations is omitted here.

Figure 9A:
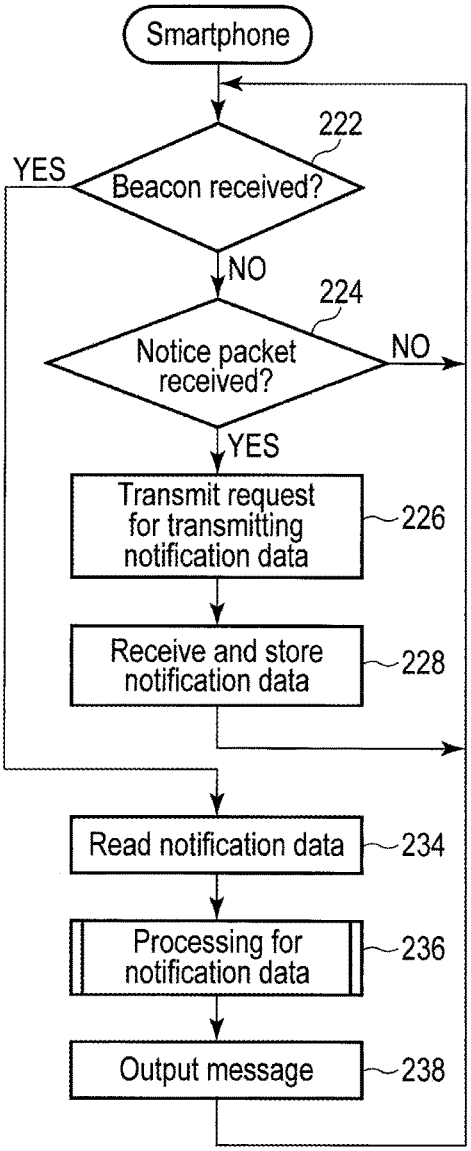
FIG. 9A is a flowchart showing an example of the procedure of a cooperation process executed by an electronic apparatus according to a second embodiment.
Figure 9B:
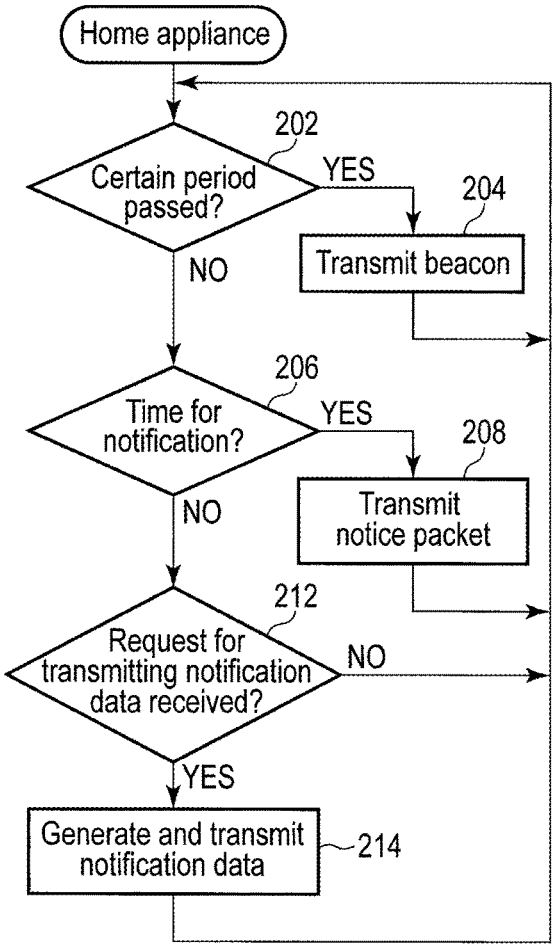

This specification discusses the procedure of cooperation between a home appliance 10 and a smartphone 20 according to a second embodiment, referring to the flowcharts of FIGS. 9A and 9B.

In the first embodiment, if an event to be presented to the user has occurred, the home appliance 10 generates notification data and stores it in the database 72 or 82. If the smartphone 20 has approached the home appliance 10, received a beacon and transmitted a request for transmitting notification data to the home appliance 10, the home appliance 10 reads the notification data from the database 72 or 82 and transmits the read notification data to the smartphone 20. Thus, a message based on the notification data is presented to the user if the user having the smartphone 20 has approached the home appliance 10.

In the second embodiment, if an event to be presented to the user has occurred, the home appliance 10 generates notification data and transmits it to the smartphone 20. Even if the smartphone 20 has received the notification data, the smartphone 20 does not present a message based on the notification data to the user and stores the notification data in a database (for example, in the notification database 58).

In the first embodiment, a beacon and notification data can be transmitted using the BLE communication function. However, in the second embodiment, notification data is transmitted using a function different from that of a beacon, specifically, using a function of near-field communication based on Wi-Fi, Bluetooth, etc. Therefore, even if a beacon cannot be received, the smartphone 20 can receive notification data or a notice packet from a home appliance 10.

In the second embodiment, if the smartphone 20 has approached the home appliance 10 and received a beacon, the smartphone 20 reads notification data from the database. Thus, in the second embodiment, a message based on the read notification data is presented to the user if the user having the smartphone 20 has approached the home appliance 10.

In the second embodiment, as shown in FIG. 9B, the home appliance 10 determines whether a certain period has passed, for example, whether several hundred milliseconds have passed (block 202). If a certain period has passed (Yes in block 202), the home appliance 10 resets the timer and transmits a beacon (block 204). After transmitting the beacon, the processing returns to block 202. Thus, the home appliance 10 transmits a beacon at regular intervals.

If the home appliance 10 determines that a certain period has not passed since the home appliance 10 transmitted the previous beacon (No in block 202), the home appliance 10 determines whether the current time is the time for notification (block 206). If the current time is the time for notification (Yes in block 206), for example, if a change in the state or abnormality of the appliance 10 has been detected, or if a predetermined notification time has been reached, the home appliance 10 transmits a notice packet (block 208). After transmitting the notice packet, the processing returns to block 202.

If the home appliance 10 determines that the current time is not the time for notification (No in block 206), the home appliance 10 determines whether the home appliance 10 has received a request for transmitting notification data from the smartphone 20 (block 212). If the home appliance 10 has not received a request for transmitting notification data (No in block 212), the processing returns to block 202. If the home appliance 10 has received a request for transmitting notification data (Yes in block 212), the home appliance 10 generates notification data as shown in FIG. 6 and transmits it to the smartphone 20 (block 214). After transmitting the notification data, the processing returns to block 202.

In this manner, the home appliance 10 transmits a beacon at regular intervals. At the time of occurrence of an event of which the home appliance 10 should notify the user, the home appliance 10 transmits a notice packet. If the home appliance 10 has received a request for transmitting notification data from the smartphone 20, the home appliance 10 transmits notification data to the smartphone 20.

As shown in FIG. 9A, the smartphone 20 determines whether the smartphone 20 has received a beacon (block 222), in other words, whether the smartphone 20 has entered a circular area within a radius of one meter of the home appliance 10.

If the smartphone 20 has not received a beacon (No in block 222), the smartphone 20 determines whether the smartphone 20 has received a notice packet from the home appliance 10 (block 224). If the smartphone 20 has not received a notice packet (No in block 224), the processing returns to block 222. If the smartphone 20 has received a notice packet, the smartphone 20 transmits a request for transmitting notification data to the home appliance 10 which is the sender of the notice packet (block 226). Specifically, if the smartphone 20 has received a notice packet from the home appliance 10, the smartphone 20 activates a notification application program 41 and causes the notification data receiver 60 to transmit a request for transmitting notification data to the home appliance 10. As described above, if the home appliance 10 has received a request for transmitting notification data (Yes in block 212), the home appliance 10 generates notification data as shown in FIG. 6 and transmits it to the smartphone 20 (block 214).

The smartphone 20 receives the notification data transmitted from the home appliance 10 and stores it in a notification database 58 of a nonvolatile memory 27 (block 228). Thus, the home appliance 10 transmits the notification data to the smartphone 20 before the smartphone 20 receives a beacon. However, the smartphone 20 does not present a message corresponding to the notification data to the user as soon as the smartphone 20 has received the notification data. The smartphone 20 stores the notification data in the database 58 to present the message corresponding to the notification data to the user later. After storing the data in the database 58, the processing returns to block 222.

If the smartphone 20 has received a beacon (Yes in block 222), the smartphone 20 reads notification data from the notification database 58 of the nonvolatile memory 27 (block 234) and performs the processing for notification data (block 236). The processing for notification data is the same as that of the first embodiment shown in FIGS. 8A and 8B. The message to be presented to the user is generated based on the notification data. The smartphone 20 presents the generated message to the user (block 238). In a manner similar to that of block 110 of the first embodiment, the message may be presented by: displaying the message as characters on an LCD 25, by using a message display processor 53; outputting a voice message corresponding to the message from a speaker 29, the voice message being generated by speech synthesis by a sound processor 54; or vibrating a vibrator 30 in accordance with the message by using a vibration processor 55.

In the present embodiment, the smartphone 20 stores, in the notification database 58 of the nonvolatile memory 27, the notification data which was received before receiving the beacon. However, the smartphone 20 may store the notification data in a main memory 23 or another storage (not shown) provided in the smartphone 20.

As explained above, in the second embodiment, if an event to be presented to the user has occurred in the home appliance 10, the home appliance 10 transmits notification data to the smartphone 20, and the smartphone 20 stores the notification data in the database. At this time, no message based on the notification data is presented to the user. If the smartphone 20 has approached the home appliance 10 and received a beacon, the smartphone 20 reads the notification data from the database and presents a message based on the notification data to the user. That is, if the user has approached the home appliance 10, the message is presented to the user. Thus, effects similar to those of the first embodiment can be obtained.

In the first embodiment, after the user has approached the home appliance 10, the smartphone 20 receives notification data from the home appliance 10 and generates a message based on the notification data. However, in the second embodiment, before the user approaches the home appliance 10, the smartphone 20 receives notification data from the home appliance 10. Thus, a message can be generated and presented to the user soon after the user has approached the home appliance 10.

Now, a third embodiment is explained.

Figure 10A:
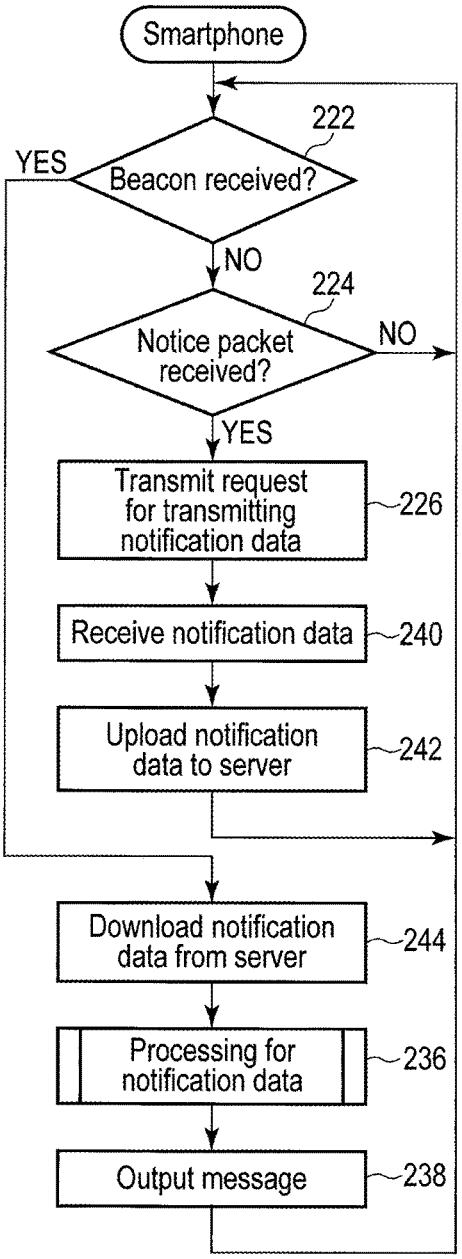
FIG. 10A is a flowchart showing an example of the procedure of a cooperation process executed by an electronic apparatus according to a third embodiment.
Figure 10B:
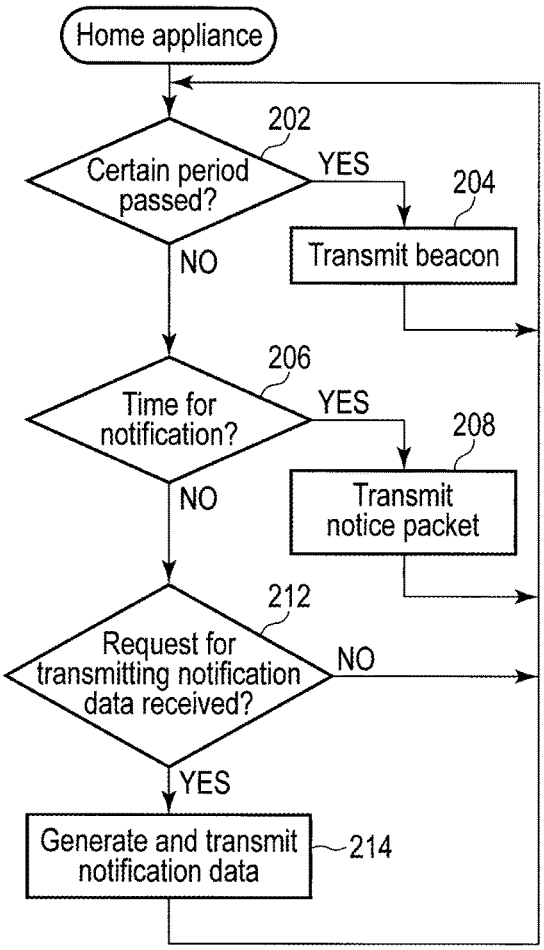
FIG. 10B is a flowchart showing an example of the procedure of a cooperation process executed by a home appliance which communicates with the electronic apparatus of the third embodiment.

This specification discusses the procedure of cooperation between a home appliance 10 and a smartphone 20 according to the third embodiment, referring to the flowcharts of FIGS. 10A and 10B.

In the second embodiment, if an event to be presented has occurred, the home appliance 10 transmits notification data to the smartphone 20 and stores it in the database 58 of the smartphone 20. The third embodiment is the same as the second embodiment in respect that the home appliance 10 transmits notification data to the smartphone 20 if an event to be presented has occurred. However, the third embodiment is different from the second embodiment in respect that the destination for storing notification data is not the database 58 of the smartphone 20 and is a database 82 of the server 18.

Thus, the operation procedure of the home appliance 10 shown in FIG. 10B is the same as that shown in FIG. 9B in the second embodiment.

The operation procedure of the smartphone 20 shown in FIG. 10A is substantially the same as that shown in FIG. 9A in the second embodiment. The smartphone 20 transmits a request for transmitting notification data (block 226) and then receives the notification data transmitted from the home appliance 10 (block 240). The operation procedure of the smartphone 20 shown in FIG. 10A is different from that shown in FIG. 9A in the second embodiment as described below. The smartphone 20 uploads (transmits) the received notification data to the server 18 (block 242). The uploaded notification data is stored in the notification database 82 of the server 18. After uploading the notification data to the server 18, the processing returns to block 222.

If the smartphone 20 has received a beacon (Yes in block 222), the smartphone 20 downloads notification data from the notification database 82 of the server 18 (block 244), and performs the processing for notification data (block 236). The smartphone presents the message generated in the processing for notification data to the user (block 238).

As explained above, in the third embodiment related to the modification of the second embodiment, in a manner similar to that of the second embodiment, if an event to be presented to the user has occurred in the home appliance 10, the home appliance 10 transmits notification data to the smartphone 20, and the smartphone 20 stores the notification data in the database 82. At this time, no message based on the notification data is presented to the user. If the smartphone 20 has approached the home appliance 10 and received a beacon, the smartphone 20 reads the notification data from the database 82 and presents a message based on the notification data to the user. That is, if the user has approached the home appliance 10, a message based on the notification data is presented to the user. Thus, effects similar to those of the first embodiment can be obtained.

In the third embodiment, the smartphone 20 uploads the notification data, which was received by the smartphone 20 before the smartphone 20 approached the home appliance 10, to the database 82 of the server 18. However, if an event to be presented has occurred, the home appliance 10 may directly upload (transmit) notification data to the database 82 of the server 18 instead of transmitting notification data to the smartphone 20.

The processing of the above embodiments may be realized by a computer program. Therefore, effects similar to those of the embodiments can be easily obtained by merely installing the computer program into a computer through a computer-readable recording medium in which the computer program is stored, and executing the computer program.

The various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic apparatus comprising:

first receiver circuitry configured to:

receive first information related with a state of a first electronic apparatus from the first electronic apparatus, wherein the first information conforms to a first standard supporting communications within a first communication distance; and receive second information related with a state of a second electronic apparatus from the second electronic apparatus, wherein the second information conforms to the first standard;

second receiver circuitry configured to:

receive a first beacon signal comprising a first identification of the first electronic apparatus from the first electronic apparatus after a reception of the first information, wherein the first beacon signal conforms to a second standard supporting communications within a second communication distance being less than the first communication distance; and receive a second beacon signal comprising a second identification of the second electronic apparatus from the second electronic apparatus after a reception of the second information, wherein the second beacon conforms to the second standard; and a hardware processor configured to:

output a first message determined based on the first information when the second receiver circuitry receives the first beacon signal after the reception of the first information; and output a second message determined based on the second information when the second receiver circuitry receives the second beacon signal after the reception of the second information.

2. The electronic apparatus of claim 1, further comprising transmitter circuitry configured to:

transmit the first information to a server after the reception of the first information.

3. The electronic apparatus of claim 1, wherein the hardware processor is further configured to:

output the first message determined based on the first information if the first information does not include an instruction related to an Internet access; and wherein the first receiver is further configured to:

receive a first data in accordance with the instruction via an Internet if the first information includes the instruction; and wherein the hardware processor is further configured to:

output the first message determined based on both the first information and the first data after a reception of the first data.

4. The electronic apparatus of claim 1, wherein the first electronic apparatus, and the transmitter circuitry is further configured to transmit the received first information to the server first receiver circuitry is further configured to:

receive a first packet related with a notice about existence of the first information from the first electronic apparatus before the reception of the first information, wherein the first packet conforms to the first standard; and wherein the transmitter circuitry is further configured to:

transmit a first request signal to the first electronic apparatus after a reception of the first packet, wherein the first request signal causes the first electronic apparatus to transmit the first information to the electronic apparatus.

5. The electronic apparatus of claim 1, further comprising a memory configured to:

store the first information after the reception of the first information; and wherein the hardware processor is further configured to:

read the first information from the memory and output the first message determined based on the first information when the second receiver receives the first beacon signal after the reception of the first information.

6. A method for an electronic apparatus, the method comprising:

receiving first information related with a state of a first electronic apparatus from the first electronic apparatus, wherein the first information conforms to a first standard supporting communication within a first communication distance; and receiving second information related with a state of a second electronic apparatus from the second electronic apparatus, wherein the second information conforms to the first standard; and receiving a first beacon signal comprising a first identification of the first electronic apparatus from the first electronic apparatus after a reception of the first information, wherein the first beacon signal conforms to a second standard supporting communications within a second communication distance being less than the first communication distance; and receiving a second beacon signal comprising a second identification of the second electronic apparatus from the second electronic apparatus after a reception of the second information, wherein the second beacon conforms to the second standard; and outputting a first message determined based on the first information when the second receiver receives the first beacon signal after the reception of the first information; and outputting a second message determined based on the second information when the second receiver receives the second beacon signal after the reception of the second information.

7. The method of claim 6, further comprising:

transmitting the first information to a server after the reception of the first information.

8. The method of claim 6, further comprising:

outputting the first message determined based on the first information if the first information does not include an instruction related to an Internet access; and receiving first data in accordance with the instruction via an Internet if the first information includes the instruction; and outputting the first message determined based on both the first information and the first data after a reception of the first data.

* * * * *